United States Patent [19]

Koizumi

[11] 4,364,252

[45] Dec. 21, 1982

[54] METHOD FOR THE MANUFACTURE OF DIAPHRAGM BELLOWS

[75] Inventor: Chie Koizumi, Kobe, Japan

[73] Assignee: Osaka Rasenkan Kogyo Kabushiki Kaisha, Osaka, Japan

[21] Appl. No.: 201,964

[22] Filed: Oct. 29, 1980

[30] Foreign Application Priority Data

Apr. 12, 1980 [JP] Japan ..... 55-48220

[51] Int. Cl.[3] ..... B21D 15/06

[52] U.S. Cl. ..... 72/59; 72/57; 72/61

[58] Field of Search ..... 72/59, 62, 61, 60, 57

[56] References Cited

U.S. PATENT DOCUMENTS 3,339,386 9/1967 Homfeldt ..... 72/59

3,704,983 12/1972 Tellot ..... 72/59

*Primary Examiner*—Leon Gilden

*Attorney, Agent, or Firm*—Wenderoth, Lind & Ponack

[57] ABSTRACT

This invention is a method for manufacturing a diaphragm bellows on a continuous basis, wherein by giving a pressure to the inside of a metallic pipe having the desired diameter, the pipe is bulged in the outer circumferential direction between opposed molds which hold the pipe and, by compressing the bulged part between molds, is formed into a steep projection of the desired shape. After removing the molds the pipe is pressed from both ends thereof to form the steep projections into flat shapes to obtain the desired diaphragm bellows and the above manufacturing procedure is repeated.

5 Claims, 8 Drawing Figures

METHOD FOR THE MANUFACTURE OF DIAPHRAGM BELLOWS

BACKGROUND AND SUMMARY OF THE INVENTION

This invention relates to a method for manufacturing a diaphragm bellows simply on a continuous basis.

Conventionally, diaphragm bellows for use with valves, expansion pipe joints, mechanical seals, and weighing machines and for joining of apparatuses are manufactured by initially piling up a plurality of processed discs having the required cross sectional shape and then by welding together the inner circumferential edges of adjoining discs and the outer circumferential edges of adjoining discs alternately, so as to obtain the desired airtightness and elasticity. However, this method requires much time for manufacturing and is not suitable for mass production.

The present invention provides a novel method for manufacturing diaphragm bellowses simply and continuously, at lower costs.

BRIEF DESCRIPTION OF THE DRAWINGS

The nature and advantages of the present invention will be understood more clearly from the following description made reference to the accompanying drawings, in which.

DETAILED DESCRIPTION OF THE DRAWINGS

Figure 3A:
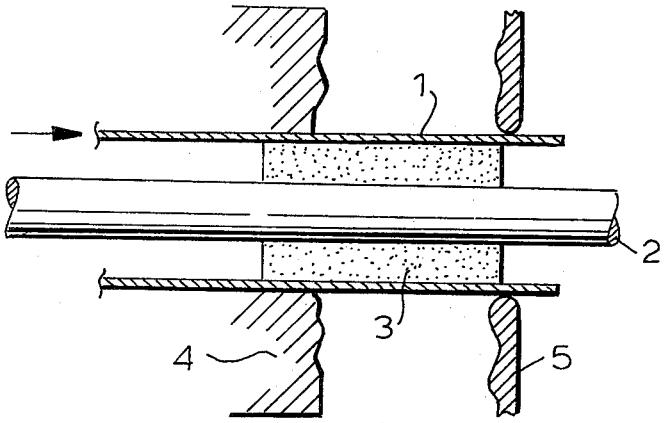
FIGS. 3*a*, 3*b* and 3*c* are schematic illustrations of successive steps of a first example of a manufacturing process in accordance with the invention.
Figure 3B:
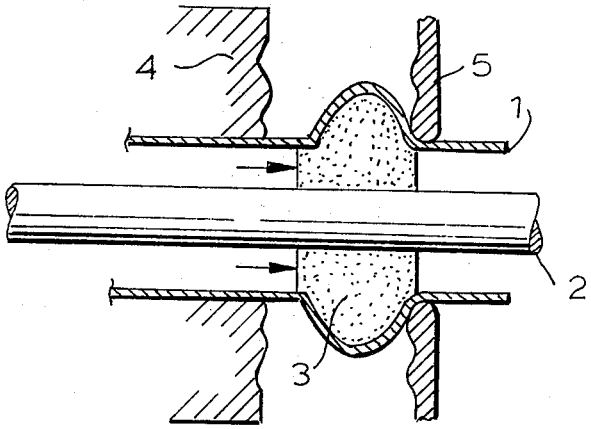
Figure 3C:
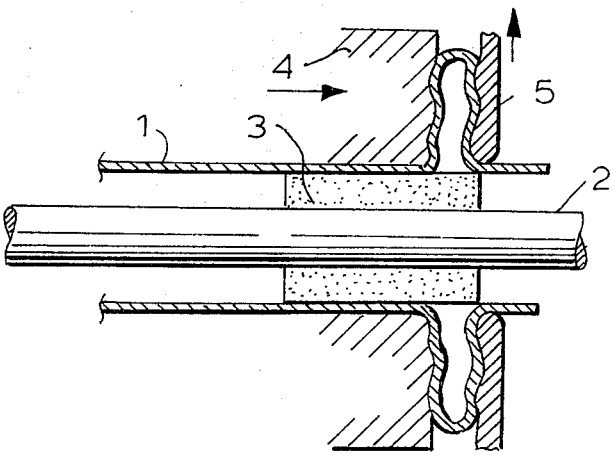

As material for the diaphragm bellows according to the present invention, a pipe 1 made of stainless steel, copper, ferrotitanium, hastelloy or the like with the desired thickness is used. The diameter of said pipe 1 is predetermined according to the inner and outer diameters of the diaphragm bellows intended for manufacture. This pipe 1 is put on the outer circumference of an elastic body 3 of tubular shape which is made of synthetic rubber, synthetic resin or the like and through which is put a core bar 2. Provided on the outer circumference of the pipe 1 are molds 4 and 5 of the pressing type. Opposed surfaces of the molds 4 and 5 are made rough, for example, corrugated, to correspond to the sectional shape of a diaphragm bellows intended for manufacture and is made divisional on the outer circumference of the pipe. As seen in FIG. 3*a*, molds 4 and 5 have curved surfaces having concave and convex portions which would mate if brought together. The molds 4 and 5 hold therebetween the outer circumference of the pipe in which the elastic body 3 is inserted. It is so arranged that the mold 5 is fixed to the pipe but the other mold 4 is movable on the pipe. One end of the elastic body 3 is fixed but the other end is not fixed and when a pressure is applied to the elastic body from the end which is not fixed, the elastic body is deformed according to the impressing pressure and bulges outwardly of the pipe's central axis, as shown in FIG. 3 (*b*).

At this time, the pipe put on the elastic body is also deformed according to the bulging of the elastic body. Then, upon releasing of the impressing pressure applied to the elastic body, the elastic body returns automatically to its original shape by its own strength, namely, by its resiliency, but the pipe which has bulged and has been deformed remain unchanged. Then, by making the molds 4 and 5 hold therebetween the outer circumference of the pipe and by narrowing distance between the both molds, the bulged part of the pipe is tightly held between them, with resultant formation of the desired corrugation, as shown by FIG. 3 (*c*). Then, the pipe is released from the mold 5, the mold 5 is divided into several sections and moved radially outward to separate it from the outer circumference of the pipe, the pipe is fed forward by one pitch by the mold 4 or other means, and the mold 5 is again fixed at the position behind the already corrugated part of the pipe to hold the outer circumference of the pipe and the mold 4 is moved back.

Figure 1:
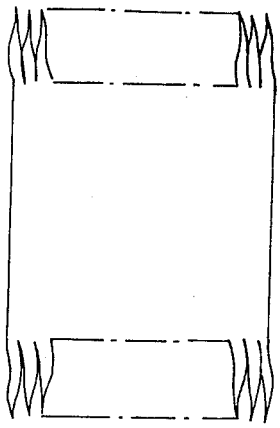
FIG. 1 is a rough cross section of a diaphragm bellows made according to the present invention.
Figure 2:
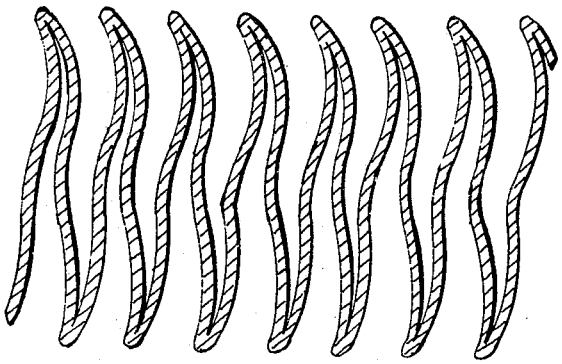
FIG. 2 is the cross section, on an enlarged scale, of the main part of the bellows shown in FIG. 1.

The above-mentioned action is repeated so as to manufacture diaphragm bellows automatically and continuously. In this manufacturing process, the span, pitch, etc. of the bellows are predetermined by taking into consideration the amount of deformation of the elastic body due to the impressing pressure, the diameter of the pipe, the extent to which the elastic body may be deformed and other factors. The pitch of corrugations of the semi-finished diaphragm bellows formed as stated above is larger than the predetermined one. Therefore, the semi-finished diaphragm bellows is drawn out of the elastic body and the core bar and a pressure is applied to it from both ends thereof by a press or the like in order to make each corrugation flat, as shown in FIG. 1 and FIG. 2, and thus the desired diaphragm bellows with mating surfaces and sharp edges at top and bottom is formed. In using this diaphragm bellows practically, flanges or the like according to the intended use, are welded to both ends thereof.

Figure 4A:
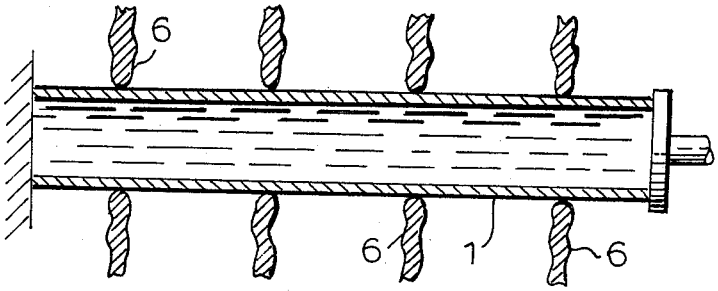
FIGS. 4*a*, 4*b* and 4*c* are schematic illustrations of successive steps of a second example of a manufacturing process in which a liquid pressure system is used.
Figure 4B:
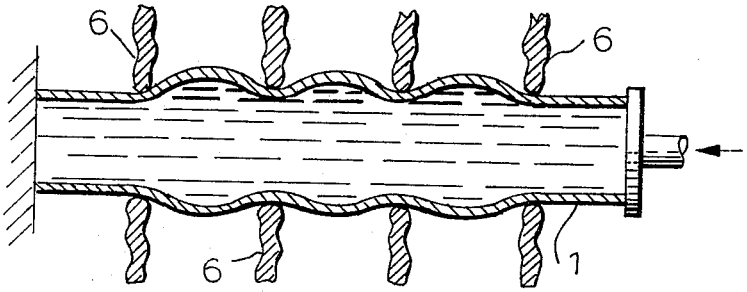
Figure 4C:
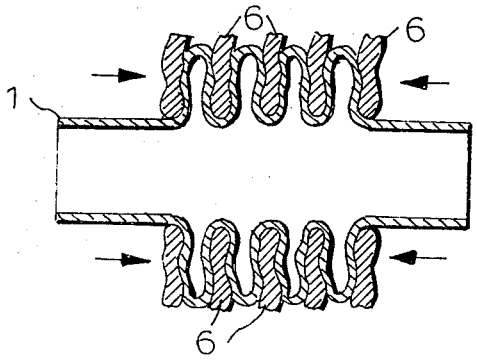

Instead of using an elastic body, a diaphragm bellows can be manufactured by using a liquid pressure type press molding method. In this case, a liquid is first sealed hermetically in a metallic pipe 1 having the designed diameter and length, A number of pressing type molds 6, are mounted on the outer circumference of pipe 1 at a pitch which is larger than the pitch of the diaphragm bellows intended for manufacture, as shown by FIG. 4 (*a*). The pipe is fixed at one end or both ends thereof and the internal pressure of the pipe is raised by applying axial pressure to one end of the pipe, whereupon the pipe bulges toward the outer circumferential direction due to the pressure of liquid sealed in the pipe. At this time, since the pipe is held at each mold part, the pipe does not bulge at that part and thus takes the continuous gourd-shape, as shown by FIG. 4 (*b*). Then, the liquid is released and the pressing force is removed, after which each distance between molds 6 is narrowed and thus each bulged part is formed into a steep projection, as shown by FIG. 4 (*c*). To this semi-finished diaphragm bellows, pressure is applied from both ends by a press or the like to obtain the desired diaphragm bellows.

In the method using an elastic body, the pitch of bellows can be determined as desired but in the case of the method which uses liquid pressure, the pitch of the bellows is limited by the number of molds to be used.

According to the present invention, diaphragm bellows having the desired span and pitch can be formed from a pipe on a continuous basis. Thus, as compared with the conventional welding method of manufacturing bellows, the method according to the present invention is a simple manufacturing process, suitable for use in a mass production system and provides uniform finished diaphragm bellows at a low cost.

What I claim is:

1. A method of manufacturing a diaphragm bellows from a metallic pipe comprising the steps of:

(1) surrounding said pipe with two spaced apart mold members having confronting side surfaces having a space therebetween, said confronting surfaces each having adjacent convex and concave portions, the convex portion of each confronting surface facing the concave confronting surface of the other;

(2) bulging a portion of said pipe into said space by imparting a pressure to the interior of said pipe;

(3) bulging a succession of adjacent portions of said pipe to form a succession of bulges in said pipe by performing steps (1) and (2) at said succession of adjacent portions; and (4) compressing said opposite sides of said bulges against respective confronting surfaces of said molds to form a longitudinal succession of projections each having gently curved wavy surfaces having convex and concave portions.

2. A method of manufacturing a diaphragm bellows from a metallic pipe comprising the steps of:

(1) surrounding said pipe with two spaced apart mold members having confronting side surfaces having a space therebetween, said confronting surfaces each having adjacent convex and concave portions, the convex portion of each confronting surface facing the concave confronting surface of the other;

(2) bulging a portion of said pipe into said space by imparting a pressure to the interior of said pipe;

(3) bulging a succession of adjacent portions of said pipe to form a succession of bulges in said pipe by performing steps (1) and (2) at said succession of adjacent portions;

(4) compressing opposite sides of said bulges against respective confronting surfaces of said molds to form a longitudinal succession of projections each having gently curved wavy surfaces having convex and concave portions;

(5) removing said molds from said pipe; and (6) compressing said succession of projections into corrugations of successively mating gently wavy surfaces.

3. A method as in claim 1, wherein said adjacent portions are bulged one at a time and said compressing step is performed on each portion before the next successive portion is bulged.

4. A method as in claim 2, wherein said adjacent portions are bulged one at a time and said compressing step is performed on each portion before the next successive portion is bulged.

5. A method as in claim 1 or claim 3, wherein said side surfaces of said two mold members are substantially mating with concave and convex parts of one side surface respectively substantially mating with convex and concave parts of the other; the method further comprising the steps of:

separating said two molds from said adjacent projections; and further longitudinally compressing said succession of projections together by applying pressure to said succession of projections at both longitudinal ends thereof for forming sharp angled edges at opposite ends of each projection, and so that adjacent ones of said gently curved wavy surfaces mate.

* * * * *